US009611574B2

(12) United States Patent
Iwasaki

(10) Patent No.: US 9,611,574 B2
(45) Date of Patent: Apr. 4, 2017

(54) SEWING TOOL HOLDER

(71) Applicant: CLOVER MFG. CO., LTD., Osaka (JP)

(72) Inventor: Chihiro Iwasaki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 14/844,234

(22) Filed: Sep. 3, 2015

(65) Prior Publication Data

US 2016/0069008 A1 Mar. 10, 2016

(30) Foreign Application Priority Data

Sep. 4, 2014 (JP) ..... 2014-180163

(51) Int. Cl.

*D05B 91/12* (2006.01)
*A41H 17/00* (2006.01)
*A44C 5/00* (2006.01)

(52) U.S. Cl.

CPC ..... *D05B 91/12* (2013.01); *A41H 17/00* (2013.01); *A44C 5/00* (2013.01)

(58) Field of Classification Search

CPC ... D05B 91/12; A45C 11/00; A45C 2011/007; A45C 2011/008; B25H 3/00; A44C 5/00; A44C 5/0007; A44C 5/003; D04D 7/04; D04D 7/06; D04D 7/08; D04D 7/10; A41H 17/00; A45F 3/48

USPC ..... D32/22

See application file for complete search history.

(56) References Cited

U.S. PATENT DOCUMENTS 853,577 A * 5/1907 Connell ..... A45F 5/00 15/227
1,187,599 A * 6/1916 Barlow ..... D05B 91/12 223/109 R
2,456,445 A * 12/1948 Rees ..... A44C 5/0046 224/221
2,600,092 A * 6/1952 Buelow ..... A45D 8/18 132/331
2006/0249169 A1* 11/2006 Lee ..... A45D 42/04 132/102

FOREIGN PATENT DOCUMENTS

DE 3631690 A1 * 3/1988
GB 459530 A * 1/1937
JP 3043144 8/1997
JP 3101736 3/2004

* cited by examiner

*Primary Examiner* — Ismael Izaguirre
(74) *Attorney, Agent, or Firm* — Hamre, Schumann, Mueller & Larson, P.C.

(57) ABSTRACT

A sewing tool holder includes a base and a plurality of of projections. The base has an obverse face and a reverse face spaced from each other in a thickness direction of the base. The plurality of projections are supported on the obverse face of the base via a common connecting portion attached to the base. Each of the plurality of projections has an upper or front end and a root or lower end that is connected to the common connecting portion.

13 Claims, 9 Drawing Sheets

SEWING TOOL HOLDER

BACKGROUND OF THE INVENTION

1. Field of the Invention

The present invention relates to a sewing tool holder for holding sewing tools such as clips and marking pins for sewing.

2. Description of Related Art

Typically, needles for sewing such as sewing needles and marking pins are stuck into and held in a pincushion made of a cushioning material or the like when they are not used. Furthermore, a needle holder is also proposed in which, instead of a pincushion made of a cushioning material, the magnetic force of a magnet is used to attract and hold needles for sewing and the like (see Japanese Utility Model Registration No. 3101736, for example). With such a needle holder using a magnet, metal needles for sewing can be clustered together and rigidly held.

Also, a wrist-worn needle holder is known that can be worn on a user's arm (mainly the wrist portion) during a sewing operation (see Japanese Utility Model Registration No. 3043144, for example). The wrist-worn needle holder shown in Japanese Utility Model Registration No. 3043144 includes a band portion that can be worn around a wrist, and a main body portion that is supported on the band portion, as shown in FIG. 9 of this document. The main body portion includes a semi-spherical cushioning material. In use, a plurality of needles for sewing can be stuck into and held in the cushioning material of the main body portion, and the needles for sewing held in the cushioning material can be drawn and used in the sewing operation. With this sort of wrist-worn needle holder, operations of holding needles for sewing and the like can be performed at a user's hand.

Meanwhile, during a sewing operation, clips may be used to, for example, temporarily tack a fabric that is difficult to be pinned with marking pins. For this sort of temporary tacking, a relatively large number of clips may be used at one time. The above-described needle holder can hold marking pins and the like, but cannot actually hold clips.

SUMMARY OF THE INVENTION

The present invention has been proposed in view of these circumstances, and it is an object thereof to provide a sewing tool holder suited to hold sewing tools such as clips for sewing.

According to an embodiment of the present invention, there is provided a sewing tool holder that includes: a base having an obverse face and a reverse face spaced from each other in a thickness direction; and a plurality of projections supported on the obverse face of the base, wherein each of the plurality of projections has a front end and a root end, where the front end is farther from the obverse face of the base than is the root end.

Preferably, the plurality of projections include at least two adjacent projections, where a distance between the front ends of the two adjacent projections is greater than a distance between the root ends of the two adjacent projections.

Preferably, the plurality of projections are disposed to define a substantially circular envelope surrounding the plurality of of projections as viewed in the thickness direction.

Preferably, the plurality of projections include a first projection and a second projection, where the first projection is farther from a center of the envelope than is the second projection, and the front end of the first projection is closer to the base in the thickness direction than is the front end of the second projection.

Preferably, the first projection mentioned above is greater in width than the second projection.

Preferably, the plurality of projections are made of a soft material.

Preferably, the soft material is felt.

Preferably, the base is made of felt.

Preferably, the sewing tool holder further includes a common connecting portion that is formed integral with the plurality of of projections, where the common connecting portion is wound into a spiral around a center of the envelope mentioned above.

Preferably, the sewing tool holder further includes a band that supports the reverse face of the base.

Preferably, the band is detachably attached to the base.

Other features and advantages of the present invention will become more apparent from the detailed description given below with reference to the accompanying drawings.

BRIEF DESCRIPTION OF THE DRAWINGS

FIG. 4A is a plan view thereof, and FIG. 4B is a side view thereof.

DESCRIPTION OF THE PREFERRED EMBODIMENT

Hereinafter, preferred embodiments of the present invention will be specifically described with reference to the drawings.

Figure 1:
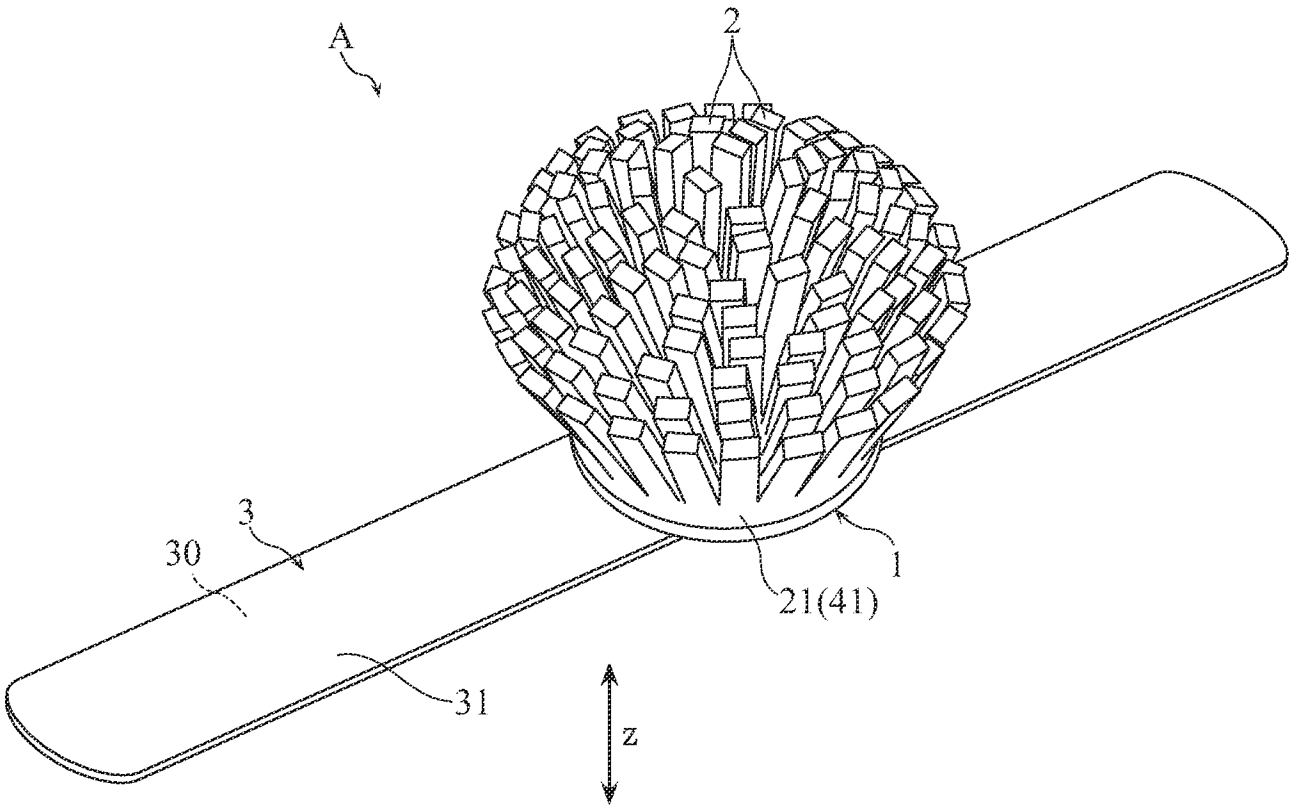
FIG. 1 is a perspective view showing an example of a sewing tool holder according to the present invention.
Figure 2:
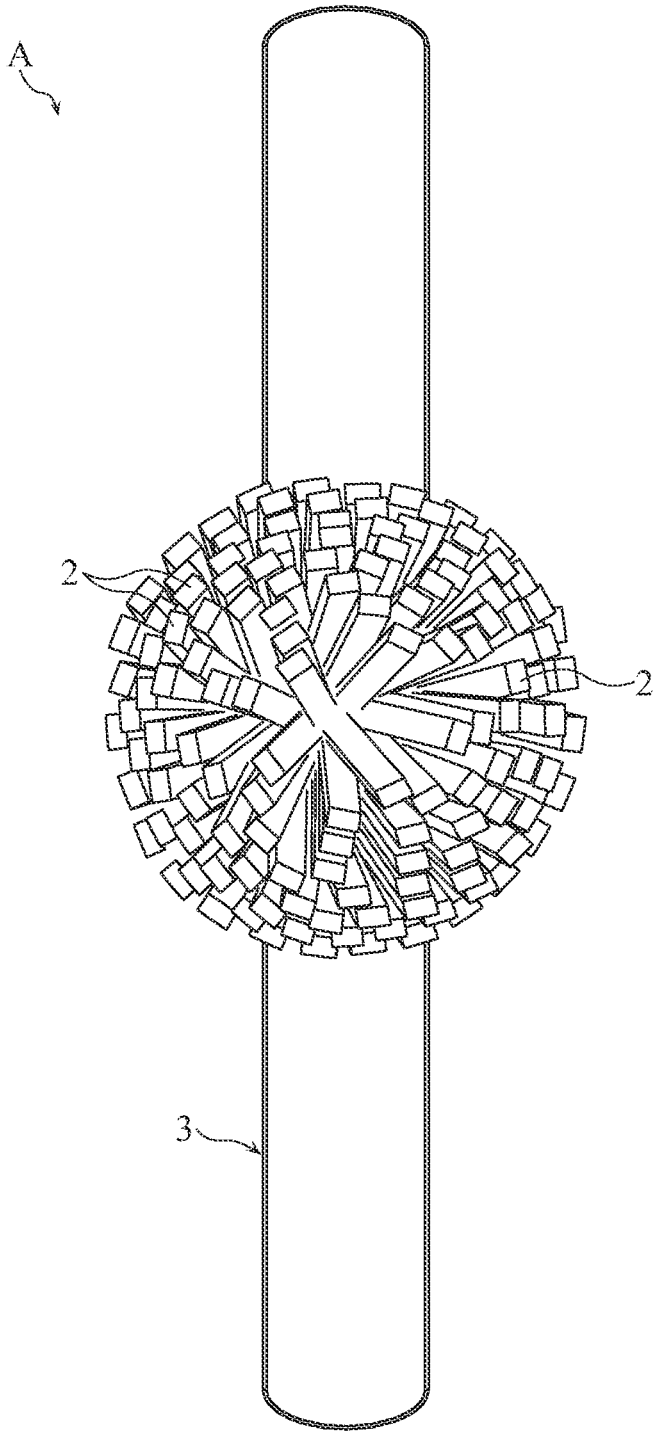
FIG. 2 is a plan view of the sewing tool holder shown in FIG. 1.
Figure 3:
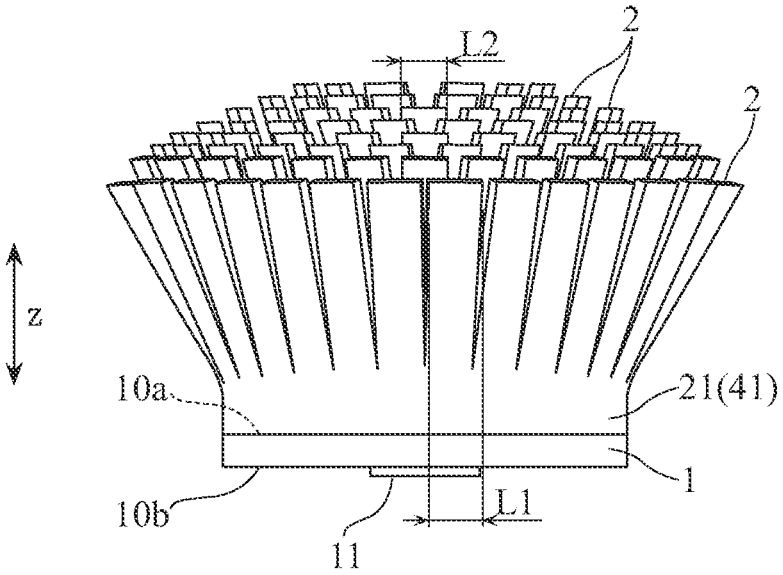
FIG. 3 is a side view of the sewing tool holder shown in FIG. 1.

FIGS. 1 to 3 show an example of a sewing tool holder according to an embodiment the present invention. A sewing tool holder A of this embodiment includes a relatively thin base 1, a plurality of projections 2 that are supported on the base 1, and an elongated band 3 that supports the base 1. In FIG. 3, the band 3 is not illustrated.

In this embodiment, the base 1 is in the shape of a circular plate or disk, and is made of felt, for example.

The plurality of projections 2 are supported on an obverse face 10*a* of the base 1. In this embodiment, the plurality of projections 2 are supported on the base 1 via a common connecting portion 21, and as a whole extend in a thickness direction z of the base 1. More specifically, each projection 2 has a free front end and a fixed root end attached to the common connecting portion 21. As seen from FIG. 3, the front end of each projection 2 is father from the obverse face

10*a* of the base 1 in the direction z (thickness direction of the base 1) than is the root end of the same projection. The plurality of projections 2 are spread apart such that the gaps between adjacent projections increase toward the tips thereof. As clearly seen in FIG. 2, the outer circumferential shape (or the "envelope") of the projections 2 as a whole is substantially circular as viewed in the direction z.

As shown in FIGS. 1 and 3, the plurality of projections 2 are such that dimensions in the direction z from the base 1 to the tips of the projections 2 are reduced the closer they are toward the outer circumference as viewed in the direction z. Accordingly, the plurality of projections 2 as a whole have a convex shape. Among the plurality of projections 2, a dimension L1 (width) in the circumferential direction of a projection 2 positioned at the outermost circumference is larger than a dimension L2 in the circumferential direction of any other projection 2.

The plurality of projections 2 are made of an elastically deformable soft material, and, in this embodiment, made of felt. The projections 2 are formed from a sheet member 4 (see FIGS. 4A and 4B), and are formed by spirally winding the sheet member 4.

Figure 4A:
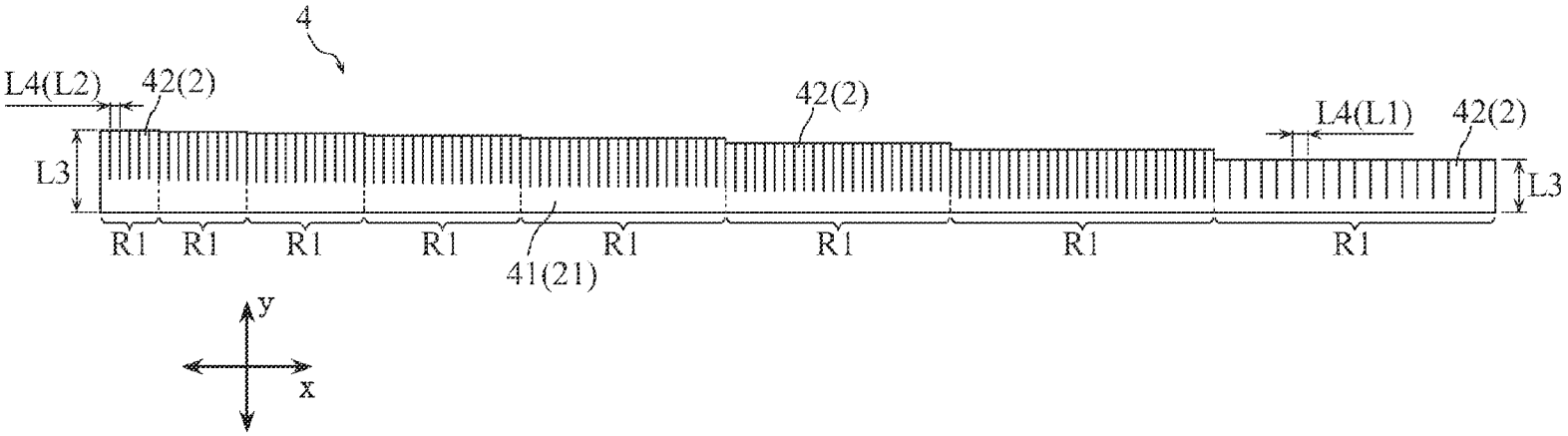
FIGS. 4A and 4B show unwound states of a sheet member, where
Figure 4B:
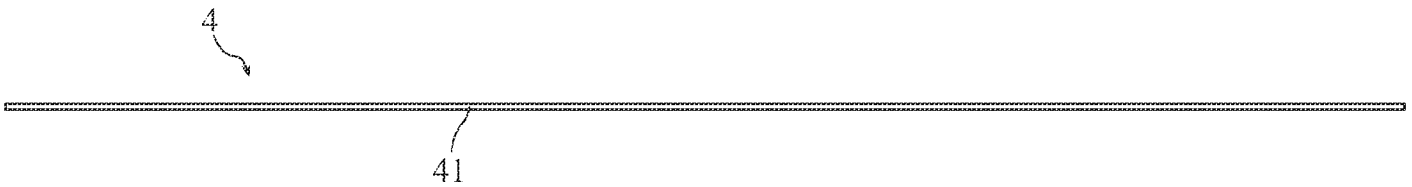

FIGS. 4A and 4B show unwound states of the sheet member 4 forming the plurality of projections 2. The sheet member 4 is made of felt having a substantially constant thickness. As shown in FIG. 4A, the sheet member 4 includes a base end portion 41 (corresponding to the common connecting portion 21 noted above) that extends in a direction x, and extending pieces 42 formed integral with the base end portion 41. The plurality of extending pieces 42 extend in a direction y orthogonal to the direction x, and are arranged side by side in the direction x. The plurality of extending pieces 42 are formed, for example, by making cuts at predetermined intervals into the sheet member 4. The cuts can be accurately made, for example, by laser cutting.

When the base end portion 41 of the sheet member 4 is wound in the circumferential direction, the plurality of extending pieces 42 form the plurality of projections 2. In the sheet member 4 shown in FIG. 4A, the left side is positioned at the center after the sheet member 4 is wound, and the right end is positioned on the outer circumferential side. In this embodiment, the length dimensions L3, measured in the direction y from the lower elongated edge of the base end portion 41 to the tips of the extending pieces 42, are reduced in a stepwise manner from the left side toward the right side in FIG. 4A. Furthermore, the width dimensions L4 in the direction x of the extending pieces 42 are so set that the dimension L1 (near the right side in FIG. 4A) is greater than the dimension L2 (for other portions). The stepwise change in the length dimension L3 is set by considering the resulting arrangement that the length of one turn is to increase toward the outside when the sheet member 4 is wound. Thus, in FIG. 4A, the x-dimensions of the respective regions R1 (in any one of the regions R1, the length dimension L3 is the same) are determined in light of the length in the circumferential direction after the sheet member 4 (the base end portion 41) is wound.

If the thus configured sheet member 4 is tightly wound such that the base end portion 41 is in the form of a spiral, as shown in FIGS. 1, 3, etc., the plurality of projections 2 as a whole have a convex shape, and are spread apart on the tip side. Then, the spirally wound sheet member 4 (base end portion 41) is fixed to the obverse face 10*a* of the base 1 by an appropriate method such as sewing or gluing.

For example, the dimensions of the sheet member 4 are such that the thickness is approximately 3 mm and the length dimension L3 from the base end portion 41 to the tips of the extending pieces 42 is at most approximately 42 mm and at least approximately 27 mm. The width dimensions L4 of the extending pieces 42 are such that the dimension L1 in the portion corresponding to the outermost circumference is approximately 8 mm and the dimension L2 in the other portions is approximately 5 mm. Furthermore, the lengths of cuts made between adjacent extending pieces 42 are such that the dimension in the portion corresponding to the outermost circumference is approximately 20 mm and the dimension in the other portions is approximately 25 mm.

Figure 5:
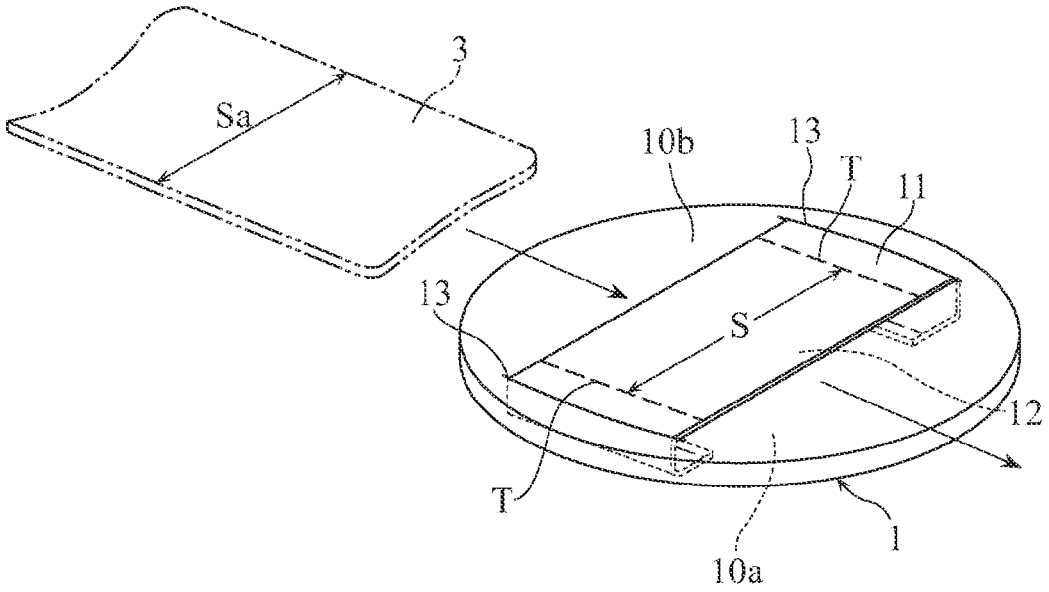
FIG. 5 is a perspective view of a base portion shown in FIG. 3 viewed from the reverse face side.

FIG. 5 is a perspective view depicting the reverse face 10*b* of the base 1 shown in FIG. 3. In FIG. 5, the common connecting portion 21 and the plurality of projections 2 are omitted. As shown in FIG. 5, a piece of cloth 11 is attached to the reverse face 10*b*. The cloth piece 11 may be attached, for example, using a method that sews the cloth piece 11 to the base 1 using a sewing thread. The cloth piece 11 may be, for example, an elastic piece such as a rubber band, or a non-elastic piece. A gap 12 is formed between the reverse face 10*b* and the cloth piece 11. This gap 12 allows the band 3 to be inserted therethrough, and has an opening width S that is defined by two threads T for sewing the cloth piece 11 to the reverse face 10*b* of the base 1. In FIG. 5, the opening width S of the cloth piece is a width that is slightly larger than a width Sa of the band 3 such that, when the band 3 is inserted through the gap 12, the base 1 is not easily displaced with respect to the band 3. In the state shown in FIG. 5, the cloth piece 11 is inserted through slits 13 that are formed through the base 1 in the thickness direction, and bent inward so as to be in contact with the obverse face 10*a*. In this state, the end portions of the cloth piece 11 are sewn to the obverse face 10*a* of the base 1. With this configuration, the cloth piece 11 does not appear on the outer circumferential face of the base 1, and, thus, the appearance is good. Furthermore, since the cloth piece 11 is sewn to both faces (the reverse face 10*b* and the obverse face 10*a*) of the base 1, the cloth piece 11 is rigidly attached to the base 1.

The band 3 is used to enable the sewing tool holder A to be worn on a user's arm. The band 3 includes a band-like flexible plate 30 and a cover member 31 that covers the outer surface of the flexible plate 30, and as a whole has a band-like shape. The cover member 31 is made of a flexible material such as rubber or soft resin. The flexible material is a material that is elastically deformed following the deformation of the flexible plate 30, which will be described later. Examples of such materials include silicone rubber. The band 3 in which the flexible plate 30 is covered by the cover member 31 can be obtained, for example, by insert molding.

Figure 6:
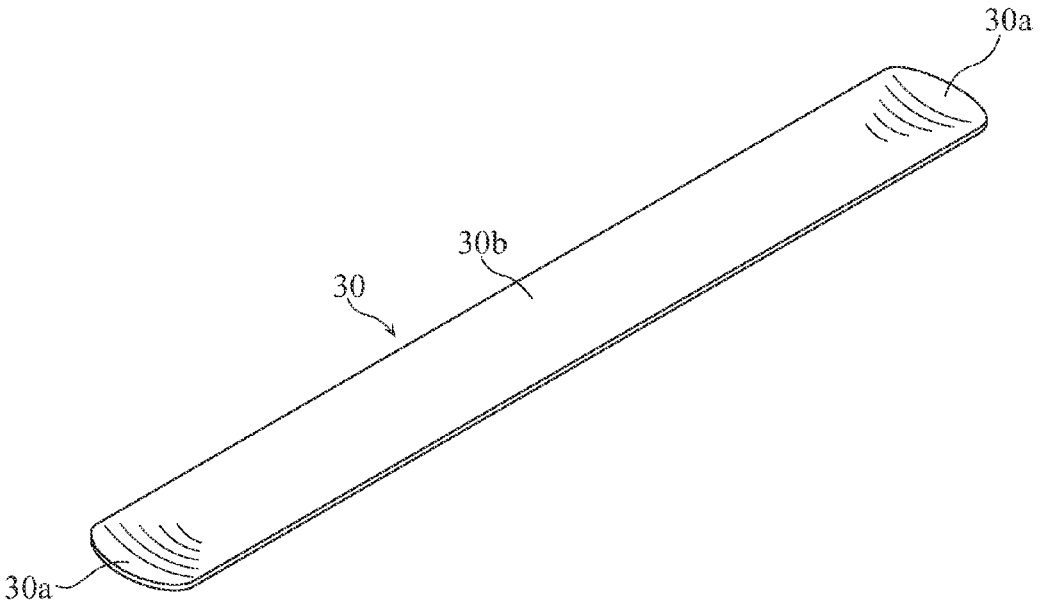
FIG. 6 is a perspective view of a flexible plate forming a band member.
Figure 8:
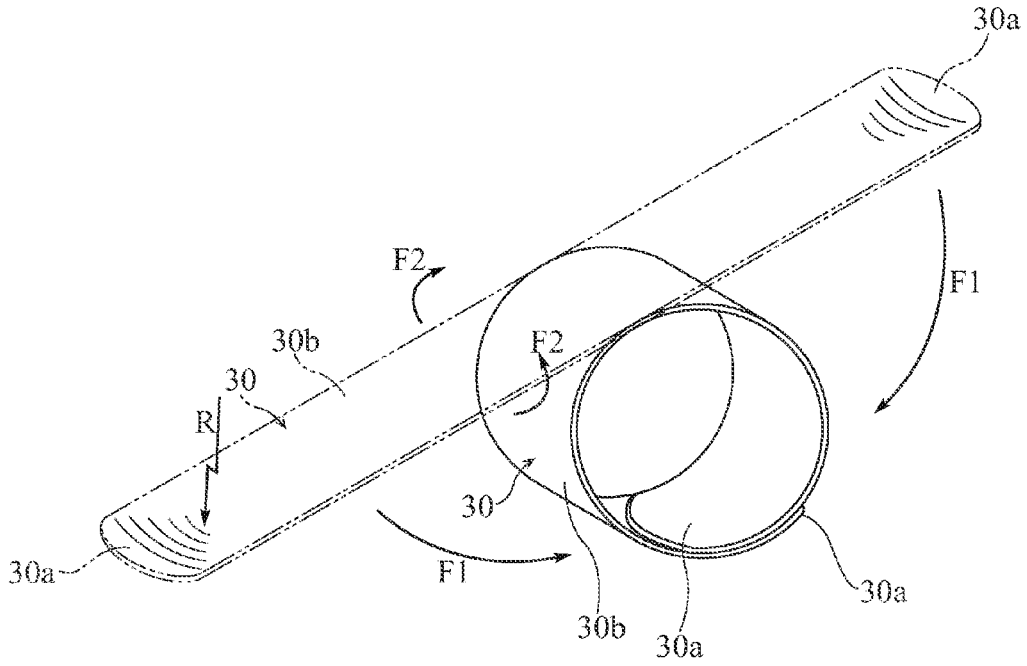
FIG. 8 is a perspective view showing a state in which the flexible plate forming the band member is deformed.

The flexible plate 30 is made of a thin plate-like spring steel plate. The flexible plate 30 can be deformed to a first form that is overall flattened in a straight line as shown in FIGS. 1, 6, etc., and to a second form that is overall curved into a ring shape with both end portions 30*a* in the longitudinal direction positioned close to each other as indicated by the solid line in FIG. 8, and can be kept in these forms. More specifically, the flexible plate 30 has a first spring property that exhibits spring forces indicated by the symbols F1 in FIG. 8, thereby curving the flexible plate 30 in the longitudinal direction such that the end portions 30*a* in the longitudinal direction of the flexible plate 30 are positioned close to each other. Furthermore, the flexible plate 30 has a second spring property that exhibits spring forces F2, thereby curving the flexible plate 30 in the lateral direction such that a single face 30*b* of the flexible plate 30 is curved downward to form a concave face having a predetermined radius R of curvature, as indicated by the dash double-dotted line in FIG. 8. Of the front and back faces of the flexible plate 30, the single face 30*b* curved downward to form a concave face is a face that is positioned on the outer side when the flexible plate 30 is curved as indicated by the solid line in FIG. 8.

Figure 7:
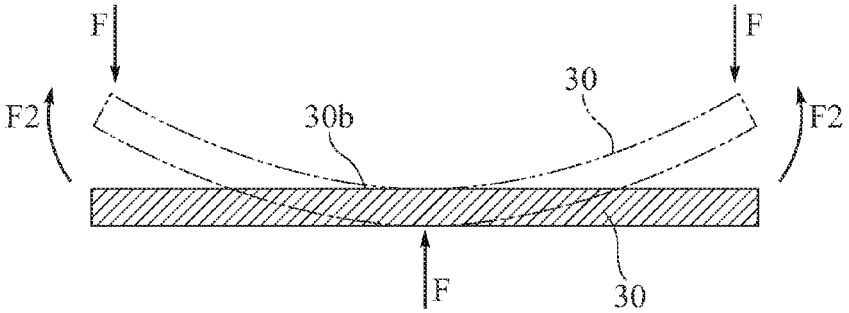
FIG. 7 is an explanatory view showing a state in which the flexible plate forming the band member is deformed.

The flexible plate 30 can be deformed as follows because it has the first spring property and the second spring property as described above. That is to say, when the flexible plate 30 is flattened in a straight line resisting the spring forces F1, the flexible plate 30 is curved in the lateral direction due to the second spring property, so that the first spring property is suppressed and the form that is flattened in a straight line is maintained. Furthermore, in the form where the flexible plate 30 is flattened in a straight line in this manner, if forces F are applied to part of the flexible plate 30 curved in the lateral direction as indicated by the dash double-dotted line in FIG. 7 so that the shape in the lateral direction of the flexible plate 30 is not curved (is in a straight line) resisting the spring forces F2, the flexible plate 30 exhibits the first spring property, so that the flexible plate 30 is overall curved into a ring shape due to the spring forces F1 as indicated by the solid line in FIG. 8. When the flexible plate 30 is curved in this manner, the flexible plate 30 is not curved in the lateral direction. Since the band 3 is mainly formed from the flexible plate 30, the band 3 can be deformed to the above-described first and second forms, and can be kept in these forms, as in the case of the flexible plate 30.

In this embodiment, as described above, if the band 3 is inserted through a gap between the cloth piece 11 and the reverse face 10*b* of the base 1, the base 1 is supported on the band 3. In this manner, the band 3 is detachably attached to the base 1.

Next, an example of how to use the sewing tool holder A and the advantages of the holder A will be described with reference to FIGS. 9 and 10.

Figure 9:
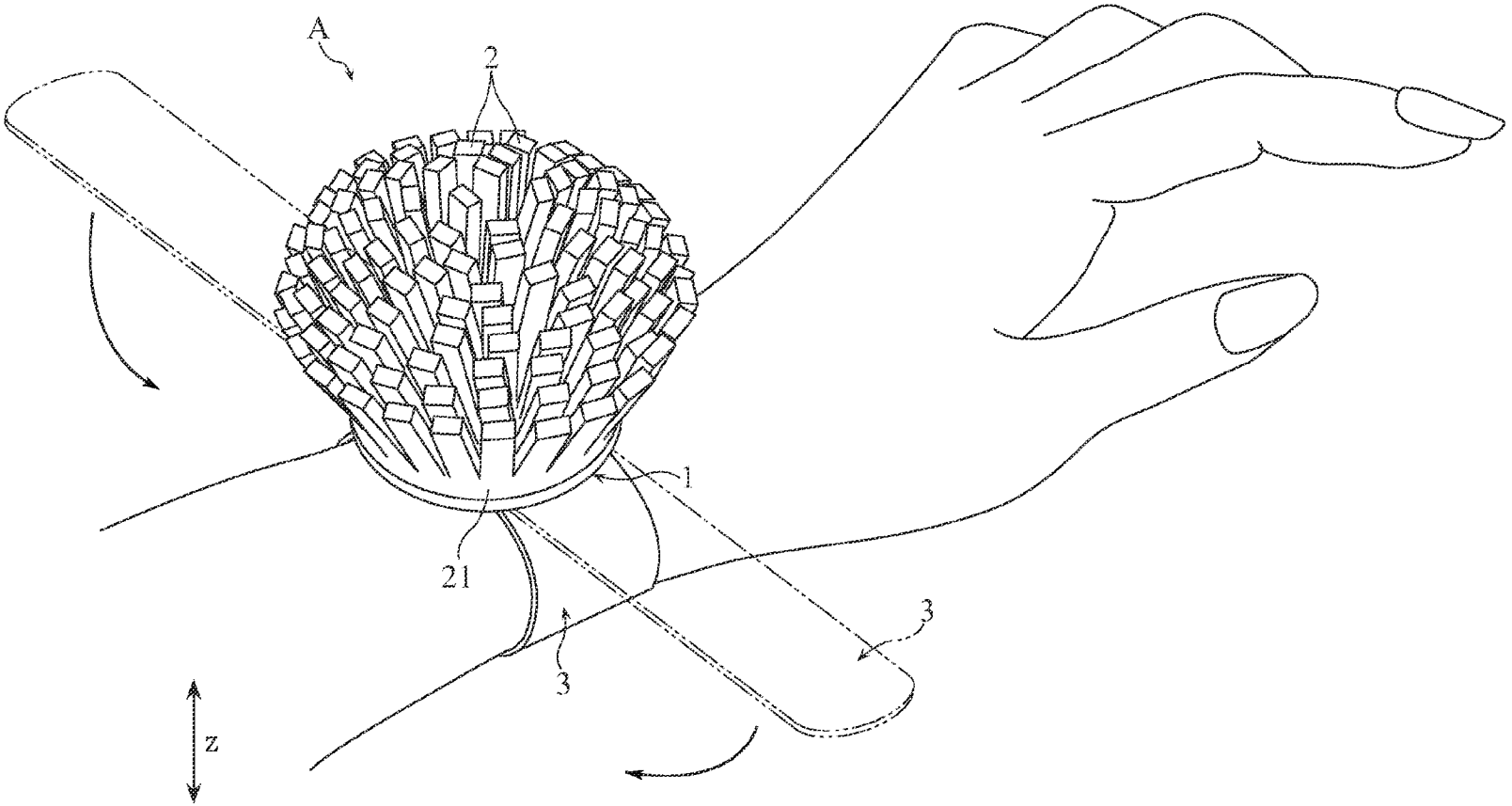
FIG. 9 is a perspective view showing an in-use state of the sewing tool holder shown in FIG. 1.
Figure 10:
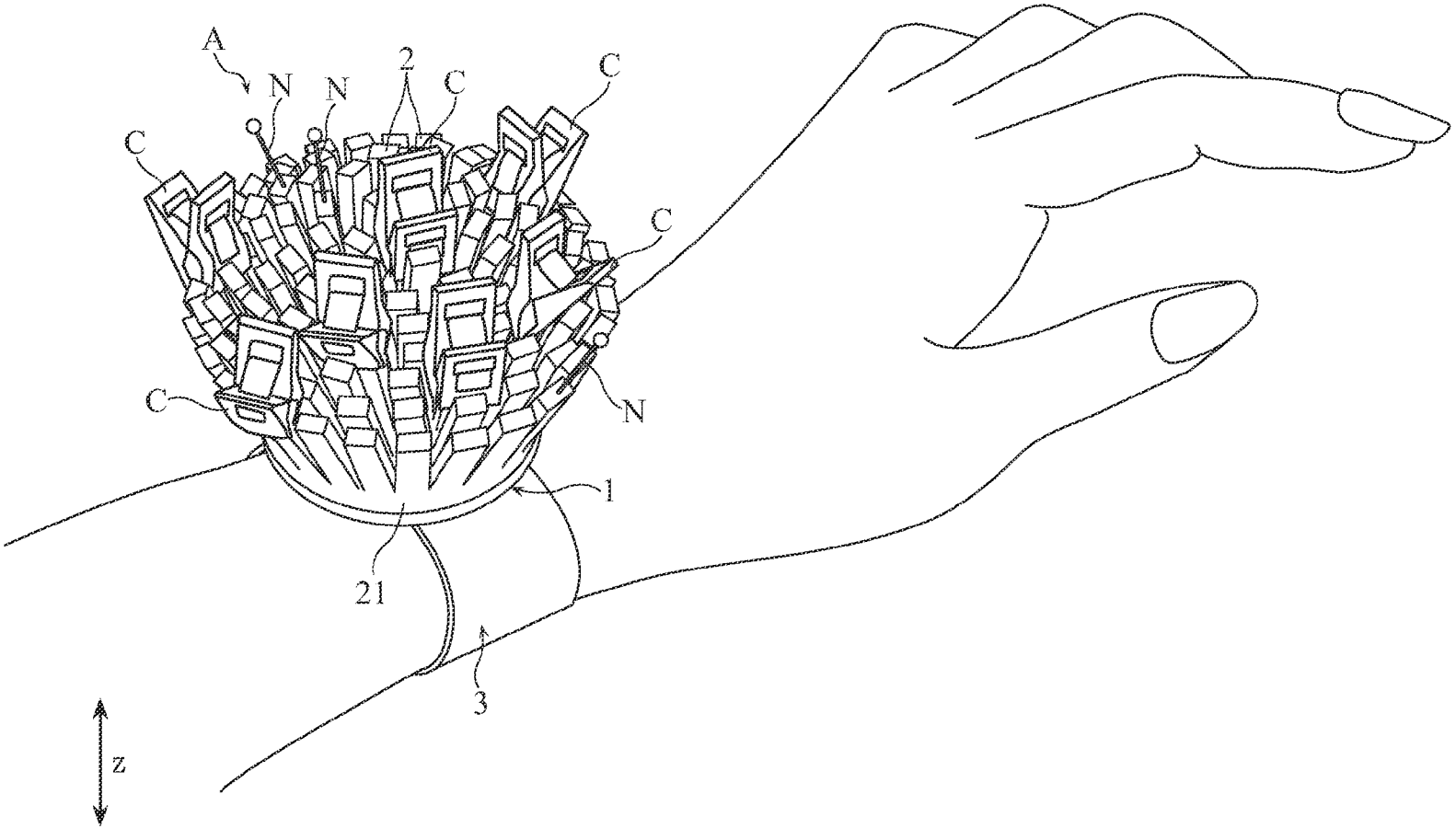
FIG. 10 is a perspective view showing an in-use state of the sewing tool holder shown in FIG. 1.

When using the sewing tool holder A, the sewing tool holder A is set in the state shown in FIG. 1, after which the sewing tool holder A is placed on a user's arm (wrist) as shown in FIG. 9, and part of the band 3 flattened in a straight line is pressed from above. Thus, the first spring property of the flexible plate 30 is exhibited, and the band 3 is curved in the longitudinal direction into a ring shape, so that the sewing tool holder A can be worn on the user's arm. In this manner, the sewing tool holder A can be worn as appropriate on the user's arm with a so-called one-touch operation, that is, the wearing operation is very easy.

The sewing tool holder A includes the plate-like base 1 and the plurality of projections 2 that are supported on the obverse face 10*a* of the base 1, and the plurality of projections 2 on the whole extend in the thickness direction z of the base 1. With this configuration, when holding sewing tools such as clips C for sewing, for example, the clips C can be held by clipping the clips C on the projections 2 as shown in FIG. 10. Furthermore, since the plurality of projections 2 on the whole extend in the thickness direction z of the base 1, the clips C can be easily held on any of the projections 2, by moving the clips C in an opened state in the direction z toward the projections 2 and then closing the clips C. Thus, according to the sewing tool holder A of this embodiment, a plurality of clips C (sewing tools) can be held, and a sewing operation can be effectively performed even in the case where a relatively large number of clips C are used during the sewing operation.

The tips of the plurality of projections 2 are spread apart such that the gaps between adjacent projections increase toward the tips. This configuration in which the tips of the plurality of projections 2 are spread apart is suited to hold a larger number of clips C (sewing tools) with respect to the number of projections 2 because an appropriate gap is provided between adjacent projections 2, so that the clips C can be easily held. Furthermore, with the configuration in which the tips of the plurality of projections 2 are spread apart, the size of the base 1 that supports the projections 2 can be made small.

Furthermore, the outer circumferential shape of the plurality of projections 2 as a whole is substantially circular as viewed in the thickness direction z of the base 1. Furthermore, the plurality of projections 2 are such that dimensions in the direction z from the base 1 to the tips of the projections 2 are reduced the closer they are toward the outer circumference as viewed in the direction z. Accordingly, the plurality of projections 2 as a whole have a convex shape. This configuration is suited to hold a larger number of clips C (sewing tools) because interference between the clips C held on the plurality of projections 2 can be suppressed.

The plurality of projections 2 are made of a soft material. The thus configured projections 2 provide a good ease of use because it is possible not only to hold the clips C but also to hold needles N such as marking pins by sticking the needles N thereunto. Furthermore, in this embodiment, the base 1 and the plurality of projections 2 are made of felt. With this configuration, the needles N can be smoothly stuck into the projections 2. Furthermore, this configuration provides a better ease of use because the needles N can be stuck also into the base 1 made of felt, so that the region into which the needles N can be stuck is not limited to the projections 2.

Among the plurality of projections 2, the dimension L1 in the circumferential direction of a projection 2 positioned at the outermost circumference is larger than the dimension L2 in the circumferential direction of any other projection 2. Furthermore, among the plurality of projections 2, the length dimension (20 mm) of a projection positioned at the outermost circumference is smaller than the length dimension (25 mm) in the other portions. With this configuration, the flexural strength can be improved. Accordingly, sewing tools such as the clips C can be held as appropriate even at the projections 2 positioned at the outermost circumference, which is not supported by the surroundings.

As shown in FIGS. 4A and 4B, the plurality of projections 2 are formed from the sheet member 4, and the sheet member 4 includes the base end portion 41 that extends in the constant direction x, and the plurality of extending pieces 42 that continue from the base end portion 41 and are arranged side by side in the direction x. When the base end portion 41 of the sheet member 4 is wound in the circumferential direction, the plurality of extending pieces 42 form the plurality of projections 2 shown in FIGS. 1 to 3. If the sheet member 4 forms the plurality of projections 2 in this manner, the plurality of projections 2 having such a unique form can be easily formed.

The band 3 is detachably attached to the base 1. This configuration provides a good ease of use because, when the sewing tool holder A is not used, it can be stored with the band 3 being detached therefrom.

Above, a specific embodiment of the present invention was described, but the invention is not limited thereto, and various modifications can be made within the scope not departing from the spirit of the invention. Specific shapes, materials, and the like of the sewing tool holder according to the present invention are not limited to those in the foregoing embodiment.

The foregoing embodiment described the case in which a single sheet member 4 is spirally wound to form the plurality of projections 2, but there is no limitation to this. For example, a plurality of projections may be formed by preparing a plurality of sheet members, winding one of the sheet members in a rolled state, and sequentially winding another sheet member on the outer side of the already wounded sheet member. Furthermore, the base portion and the plurality of projections may be made of, for example, soft synthetic resin or a soft material such as rubber or elastomer. If the base portion and the plurality of projections are made of synthetic resin or the like, the base portion and the plurality of projections may be formed by integral molding, or portions corresponding to the plurality of projections may be attached to the base portion.

The embodiment described above includes a band 3 for attachment to the wrist of the user. The present invention, however, is not limited to this embodiment. Specifically, the sewing tool holder of the present invention may not be provided with such a band, and simply configured to be put on e.g., a table when used.

The invention claimed is:

1. A sewing tool holder, comprising:

a base having an obverse face and a reverse face spaced from each other in a thickness direction; and a plurality of projections supported on the obverse face of the base, wherein each of the plurality of projections has a front end and a root end, the front end being farther from the obverse face of the base than the root end, the plurality of projections are disposed to define a substantially circular envelope surrounding the plurality of projections as viewed in the thickness direction, the plurality of projections include a first projection and a second projection, the first projection being farther from a center of the envelope than the second projection, and the front end of the first projection is closer to the base in the thickness direction than the front end of the second projection.

2. The sewing tool holder according to claim 1, wherein the plurality of projections include at least two adjacent projections, and a distance between the front ends of the two adjacent projections is greater than a distance between the root ends of the two adjacent projections.

3. The sewing tool holder according to claim 1, wherein the first projection is greater in width than the second projection.

4. The sewing tool holder according to claim 1, wherein the plurality of projections are made of a soft material.

5. A sewing tool holder, comprising:

a base having an obverse face and a reverse face spaced from each other in the thickness direction; and a plurality of projections supported on the obverse face of the base, wherein each of the plurality of projections has a front end and a root end, the front end being farther from the obverse face of the base than the root end, wherein the plurality of projections are made of felt.

6. The sewing tool holder according to claim 5, wherein the base is made of felt.

7. A sewing tool holder, comprising:

a base having an obverse face and a reverse face spaced from each other in the thickness direction; and a plurality of projections supported on the obverse face of the base, and a common connecting portion integral with the plurality of projections, wherein each of the plurality of projections has a front end and a root end, the front end being farther from the obverse face of the base than the root end, the plurality of projections are disposed to define a substantially circular envelope surrounding the plurality of projections as viewed in the thickness direction, and the common connecting portion is wound into a spiral around a center of the envelop.

8. The sewing tool holder according to claim 1, further comprising a band that supports the reverse face of the base.

9. The sewing tool holder according to claim 8, wherein the band is detachably attached to the base.

10. The sewing tool holder according to claim 5, further comprising a band that supports the reverse face of the base.

11. The sewing tool holder according to claim 10, wherein the band is detachably attached to the base.

12. The sewing tool holder according to claim 7, further comprising a band that supports the reverse face of the base.

13. The sewing tool holder according to claim 12, wherein the band is detachably attached to the base.

* * * * *